US010745982B2

(12) United States Patent
Pohnert et al.

(10) Patent No.: US 10,745,982 B2
(45) Date of Patent: Aug. 18, 2020

(54) POWER TONG

(71) Applicant: Universe Machine Corporation, Edmonton (CA)

(72) Inventors: Vladimir G. Pohnert, Edmonton (CA); Kurt R. Feigel, Jr., Edmonton (CA)

(73) Assignee: Universe Machine Corporation, Edmonton (CA)

( * ) Notice: Subject to any disclaimer, the term of this patent is extended or adjusted under 35 U.S.C. 154(b) by 164 days.

(21) Appl. No.: 16/007,843

(22) Filed: Jun. 13, 2018

(65) Prior Publication Data

US 2018/0355684 A1 Dec. 13, 2018

(30) Foreign Application Priority Data

Jun. 13, 2017 (CA) ..... 2970340

(51) Int. Cl.
*E21B 19/16* (2006.01)

(52) U.S. Cl.
CPC ..... *E21B 19/161* (2013.01)

(58) Field of Classification Search
CPC .... E21B 19/161; E21B 19/164; E21B 19/168; B25B 21/002; B25B 21/005
See application file for complete search history.

(56) References Cited

U.S. PATENT DOCUMENTS 2,879,680 A * 3/1959 Beeman ..... E21B 19/164 81/57.18
4,084,453 A * 4/1978 Eckel ..... E21B 19/164 81/57.18
4,089,240 A * 5/1978 Eckel ..... E21B 19/164 81/57.18
4,350,063 A * 9/1982 Koehler ..... B25B 13/52 24/279
4,404,876 A * 9/1983 Eckel ..... E21B 19/164 81/57.18
4,487,092 A * 12/1984 Neves ..... E21B 19/164 384/610
4,576,067 A * 3/1986 Buck ..... E21B 19/161 269/283
4,593,584 A * 6/1986 Neves ..... E21B 19/164 81/57.18
4,631,987 A * 12/1986 Buck ..... E21B 19/164 279/109

(Continued)

FOREIGN PATENT DOCUMENTS

CA 2016319 7/2001

*Primary Examiner* — David B. Thomas
(74) *Attorney, Agent, or Firm* — Christensen O'Connor Johnson Kindness, PLLC

(57) ABSTRACT

A power tong is provided for rotating a pipe, the power tong comprising: a frame having a pair of arcuate front portions defining a throat for receiving the pipe; a ring gear mounted for rotation on the arcuate front portions about a center of rotation, the ring gear having an opening that is alignable with the throat; and a cage plate assembly mounted for rotation on the ring gear on a bearing arrangement that includes roller bearings and a bushing sliding segment on each side of the throat. Taking the throat as having a center line that defines a zero circumferential position within the power tong, the bearing sliding segments may be located within 90 degrees of the throat center line.

20 Claims, 3 Drawing Sheets

(56) References Cited

U.S. PATENT DOCUMENTS

| | | | | |
|---|---|---|---|---|
| 4,649,777 | A * | 3/1987 | Buck | E21B 19/161 81/57.19 |
| 4,709,599 | A * | 12/1987 | Buck | E21B 19/164 81/57.18 |
| 5,144,868 | A * | 9/1992 | Feigel, Jr. | E21B 19/164 81/57.14 |
| 5,819,604 | A * | 10/1998 | Buck | E21B 19/164 81/57.18 |
| 5,904,075 | A * | 5/1999 | Buck | E21B 19/164 81/57.18 |
| 7,762,160 | B2 | 7/2010 | Basler et al. | |
| 7,882,767 | B2 * | 2/2011 | Musemeche | E21B 19/164 81/57.15 |
| 8,006,590 | B2 | 8/2011 | Light et al. | |
| 8,453,541 | B2 * | 6/2013 | Dagenais | E21B 19/164 81/57.15 |
| 9,010,219 | B2 | 4/2015 | Feigel, Jr. et al. | |
| 9,267,343 | B2 * | 2/2016 | Musemeche | E21B 19/164 |
| 10,100,593 | B2 * | 10/2018 | Musemeche | E21B 19/164 |
| 2008/0000330 | A1 * | 1/2008 | Basler | E21B 19/164 81/57.15 |
| 2011/0041656 | A1 * | 2/2011 | Dagenais | E21B 19/164 81/57.15 |
| 2018/0258718 | A1 * | 9/2018 | Smith | E21B 19/161 |

* cited by examiner

POWER TONG

TECHNICAL FIELD

This document relates to power tongs.

BACKGROUND

Power tongs are used in well drilling to rotate tubular sections that are being threaded together or unthreaded There exist numerous patents on power tongs, including the following U.S. Pat. No. 5,144,868 to Feigel, U.S. Pat. No. 4,709,599 to Buck, U.S. Pat. No. 4,649,777 to Buck, U.S. Pat. No. 4,631,987 to Buck, U.S. Pat. No. 4,576,067 to Buck, U.S. Pat. No. 4,593,584 to Neves (equivalent to Canadian patent 1,235,111), U.S. Pat. No. 4,487,092 to Neves, U.S. Pat. No. 4,404,876 to Eckel, U.S. Pat. No. 4,350,062 to Farr et al, (equivalent to Canadian patent 1,125,737), U.S. Pat. No. 4,089,240 to Eckel, U.S. Pat. No. 4,084,453 to Eckel, and U.S. Pat. No. 2,879,680 to Beeman et al; and the following Canadian patents: 1,190,919 to Farr et al, 1,088,918 to Eckel 1,075,676 to Eckel, and 1,037,463 to Eckel.

All of these power tongs include a frame having arcuate front portions defining a throat, a ring gear mounted on the frame for rotation about a central axis, and a cage plate assembly mounted on either the frame or the ring gear for rotation about a central axis. The throat receives the tubular section to be rotated, and the cage plate and ring gear include die means for gripping the pipe. The ring gear and cage plate cooperate to rotate the pipe within the frame, which remains stationary. In these design, the ring gear was mounted for rotation on the frame. In a diversion from these designs, the inventor proposed the design of U.S. Pat. No. 9,010,219, in which a power tong is disclosed for rotating a pipe, the power tong comprising: a frame having a pair of arcuate front portions defining a throat for receiving the pipe; a cage plate assembly mounted for rotation on the arcuate front portions about a center of rotation, the cage plate assembly having an opening that is alignable with the throat; a ring gear mounted for rotation within, and supported by, the cage plate assembly about the center of rotation, the ring gear having an opening that is alignable with the throat; the ring gear cooperating with jaws mounted on the cage plate assembly for gripping the pipe upon rotation of the ring gear. It was mentioned in this patent that the ring gear might rotate on a bushing slide surface.

SUMMARY

A power tong is provided for rotating a pipe, the power tong comprising: a frame having a pair of arcuate front portions defining a throat for receiving the pipe; a ring gear mounted for rotation on the arcuate front portions about a center of rotation, the ring gear having an opening that is alignable with the throat; and a cage plate assembly mounted for rotation on the ring gear on a bearing arrangement that includes roller bearings and a bushing sliding segment on each side of the throat. Taking the throat as having a center line that defines a zero circumferential position within the power tong, the bearing sliding segments may be located within 90 degrees of the throat center line. These and other aspects of the device and method are set out in the claims.

BRIEF DESCRIPTION OF THE FIGURES

Embodiments will now be described with reference to the Figures, in which like reference characters denote like elements, by way of example, and in which.

DETAILED DESCRIPTION

Immaterial modifications may be made to the embodiments described here without departing from what is covered by the claims.

Figure 1:
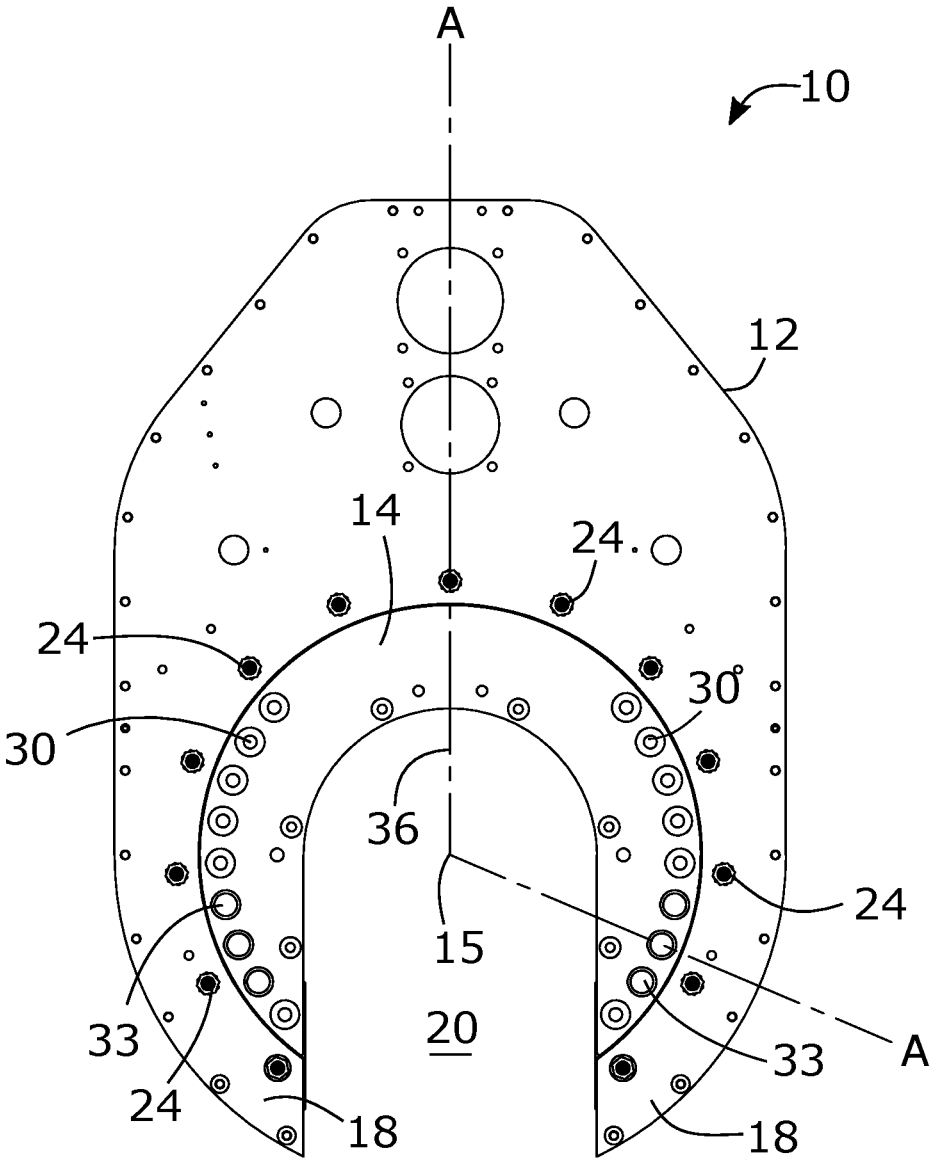
FIG. 1 is a plan view of a power tong.
Figure 2:
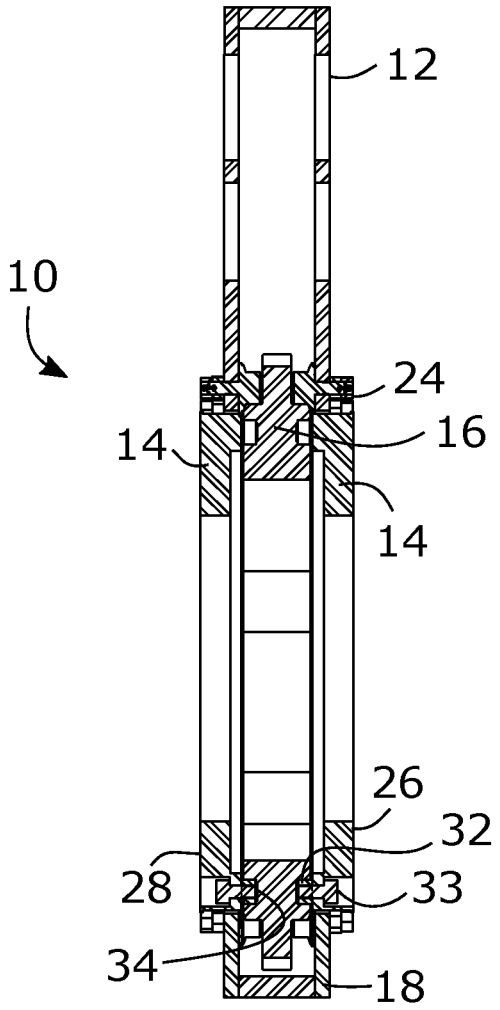
FIG. 2 is a section through the power tong of FIG. 1 along the section line A-A.
Figure 3:
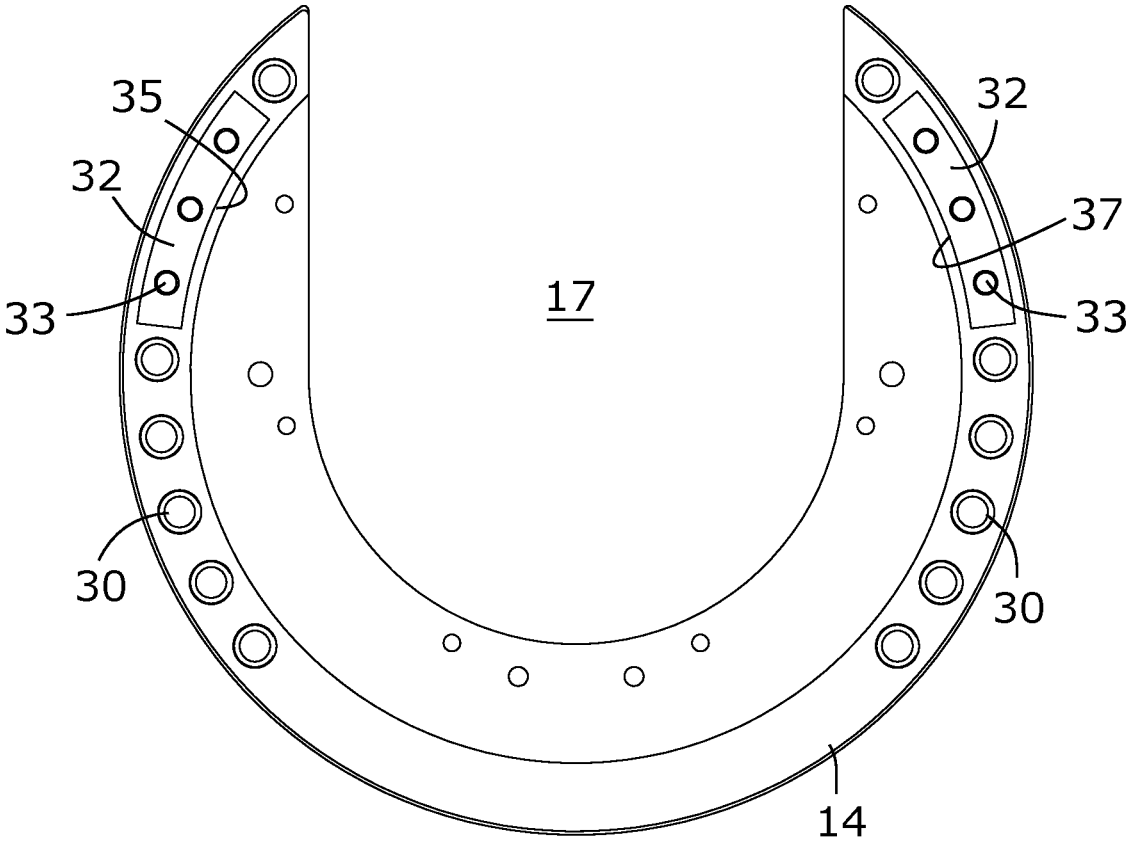
FIG. 3 is a plan view of a cage plate with a bushing sliding segment.
Figure 5:
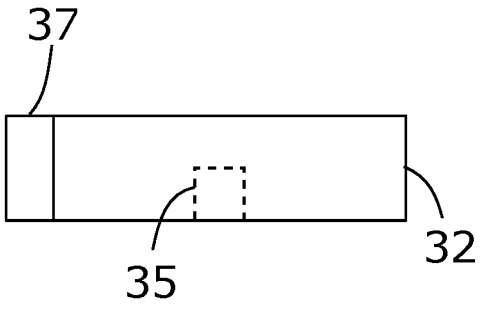
FIG. 5 is a section through a bushing sliding segment.
Figure 4:
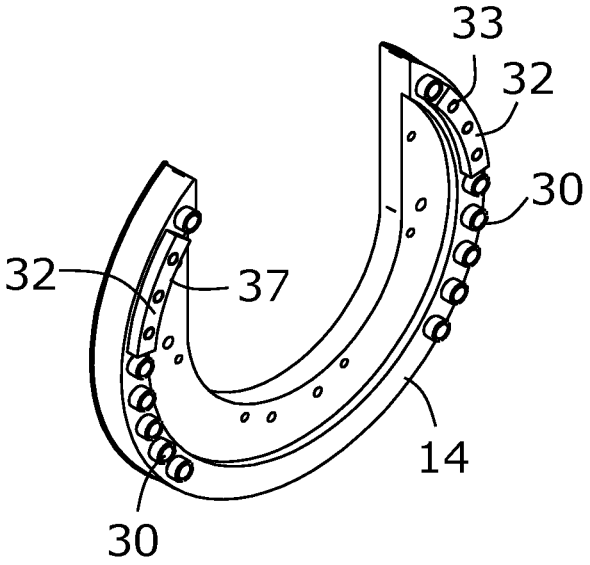
FIG. 4 is a perspective view of the cage plate of FIG. 3.

Referring to the drawings and in particular to FIGS. 1 and 2, there is shown an open throat power tong 10 according to the present disclosure. The power tong 10 is shown without conventional hydraulic drive components and gripping dies. The conventional hydraulic drive components and gripping dies and associated structure may be seen for example in U.S. Pat. No. 9,010,219, but these components are a design choice and other structure may be used. The average skilled person in the art knows how to make these convention components.

Tong 10 comprises a frame 12, a cage plate assembly 14, and a ring gear 16. Frame 12 has a pair of arms or arcuate front portions 18 defining a throat 20 for receiving a pipe (not shown). Ring gear 16 is mounted for rotation on the frame 12 and arcuate front portions 18 about a center of rotation 15, the ring gear 16 having an opening that is alignable with the throat 12. The ring gear 16 may be mounted for rotation to the frame 12 and arcuate front portions 18 by bearings 24 that are distributed around the ring gear 16.

The cage plate assembly 14 may comprise an upper cage plate 26 mounted above the arcuate front portions 18, and a lower cage plate 28 mounted below the arcuate front portions 18. The cage plate assembly 14 is mounted for rotation within, and supported by, the ring gear 16 about the center of rotation 15, the cage plate assembly 14 having an opening 17 that is alignable with the throat 12. The cage plate assembly 14 is used to resist expansion of the arcuate front portions 18 during operation of the power tong 10 when torque generated by making and breaking pipe joints causes expansionary strains on the arcuate front portions 18 of the frame 12.

Each cage plate 26, 28 of the cage plate assembly 14 may be mounted for rotation on the ring gear 16 on a bearing arrangement that includes roller bearings 30 and a bushing sliding segment 32 on each side of the throat 20. Each roller bearing 30 may comprise a rotating part that is seated on a shaft that extends through one of the cage plates 26, 28. The bushing sliding segments 32 may be secured in the cage plates 26, 28 by bolts 33 that extend through the cage plates 26, 28 and thread into openings 35 in the bushing sliding segments 32. The bushing sliding segments 32 may comprise a curved steel bar that is rectangular in section and faced on the side facing the throat 20 with a suitable low friction material such as brass 37. The curvature of the bushing sliding segments 32 on the side facing the throat 20 should follow a circle centered on the centered of rotation 15. The roller bearings 30 and bushing sliding segments 32 may travel in cooperating grooves 34 in the ring gear 16.

The throat 20 has a center line 36 that defines a zero circumferential position within the power tong 10. The bushing sliding segments 32 may be located within 90 degrees of the throat center line 36, that is, more to the front of the arms 18 or the central axis than to the back. The section line A-A in FIG. 1 extends at about 60 degrees from the throat center line 36 and intersects the bushing sliding segment 32 on one side as shown. The bushing sliding segments 32 are mirror images of each other about the throat center line. The throat center line 36 is shown in FIG. 1 as being part of the section line A-A but extends forwardly through the throat as well, and it is this forward portion that the measurement of the 90 degrees is taken from. The bushing sliding segments 32 may also be located with roller bearings 30 on each circumferential side of the bushing sliding segments 32. The plates 26 and 28 may be solid for increasing the rigidity of cage plate assembly 14.

The arcuate front portions 18 may be designed such that under normal operating conditions (equal to or lower than full rated torque) the front portions 18 will flex more than cage plate assembly 14. This objective may be realized by the selection of the materials forming the front portions 18 and the transverse width of the front portions 18 (transverse is defined in relation to the direction of the opening of the throat 12, which is oriented in the longitudinal direction). In the design shown, strain resulting from the torque of the ring gear 16 during operation may be primarily taken up by the relatively rigid cage plate. The front portions 18 of the frame may be designed to flex without reaching their maximum yield strength. The resistance for the flex may never be greater than the force the bearings 24, 30 and 32 can withstand before breaking. The ring gear 16 and cage plate assembly 14 combination may be designed rigidly enough so that when under full torque they will not increase circumferentially more than the gear train backlash will allow.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A power tong is provided for rotating a pipe, the power tong comprising a frame having a pair of arcuate front portions defining a throat for receiving the pipe;

a ring gear mounted for rotation on the arcuate front portions about a center of rotation, the ring gear having an opening that is alignable with the throat; and a cage plate assembly mounted for rotation on the ring gear on a bearing arrangement that includes roller bearings and a bushing sliding segment on each side of the throat.

2. The power tong of claim 1 in which the throat has a center line that defines a zero circumferential position within the power tong, the bushing sliding segment being located within 90 degrees of the throat center line.

3. The power tong of claim 2 in which the cage plate assembly further comprises an upper cage plate and a lower cage plate mounted for rotation on the ring gear above and below, respectively, the arcuate front portions.

4. The power tong of claim 3 in which the cage plate assembly is mounted for rotation on one or more bearing rings of the arcuate front portions.

5. The power tong of claim 4 in which the ring gear is mounted for rotation within, and supported by, the cage plate assembly through a plurality of rollers.

6. The power tong of claim 5 in which each bushing sliding segment comprises a curved bar and has a side facing the throat, the side facing the throat having a curvature that is centered on the centre of rotation.

7. The power tong of claim 6 in which each bushing sliding segment comprises a steel bar faced with brass.

8. The power tong of claim 1 in which the cage plate assembly further comprises an upper cage plate and a lower cage plate mounted for rotation on the ring gear above and below, respectively, the arcuate front portions.

9. The power tong of claim 8 in which the cage plate assembly is mounted for rotation on one or more bearing rings of the arcuate front portions.

10. The power tong of claim 9 in which the ring gear is mounted for rotation within, and supported by, the cage plate assembly through a plurality of rollers.

11. The power tong of claim 10 in which each bushing sliding segment comprises a curved bar and has a side facing the throat, the side facing the throat having a curvature that is centered on the centre of rotation.

12. The power tong of claim 11 in which each bushing sliding segment comprises a steel bar faced with brass.

13. The power tong of claim 1 in which the cage plate assembly further comprises an upper cage plate and a lower cage plate mounted for rotation on the ring gear above and below, respectively, the arcuate front portions.

14. The power tong of claim 1 in which the cage plate assembly is mounted for rotation on one or more bearing rings of the arcuate front portions.

15. The power tong of claim 14 in which the ring gear is mounted for rotation within, and supported by, the cage plate assembly through a plurality of rollers.

16. The power tong of claim 15 in which each bushing sliding segment comprises a curved bar and has a side facing the throat, the side facing the throat having a curvature that is centered on the centre of rotation.

17. The power tong of claim 16 in which each bushing sliding segment comprises a steel bar faced with brass.

18. The power tong of claim 1 in which the ring gear is mounted for rotation within, and supported by, the cage plate assembly through a plurality of rollers.

19. The power tong of claim 1 in which each bushing sliding segment comprises a curved bar and has a side facing the throat, the side facing the throat having a curvature that is centered on the centre of rotation.

20. The power tong of claim 19 in which each bushing sliding segment comprises a steel bar faced with brass.

* * * * *